US010011377B2

(12) United States Patent
Oyama

(10) Patent No.: US 10,011,377 B2
(45) Date of Patent: Jul. 3, 2018

(54) PACKAGING APPARATUS AND PACKAGING METHOD FOR ABSORBENT ARTICLE

(71) Applicant: UNICHARM CORPORATION, Shikokuchuo-shi, Ehime (JP)

(72) Inventor: Hidetaka Oyama, Itami (JP)

(73) Assignee: UNICHARM CORPORATION, Shikokuchuo-Shi, Ehime (JP)

( * ) Notice: Subject to any disclaimer, the term of this patent is extended or adjusted under 35 U.S.C. 154(b) by 199 days.

(21) Appl. No.: 14/837,596

(22) Filed: Aug. 27, 2015

(65) Prior Publication Data

US 2016/0059971 A1 Mar. 3, 2016

(30) Foreign Application Priority Data

Aug. 28, 2014 (JP) ..... 2014-174615

(51) Int. Cl.

| | |
|---|---|
| ***B65B 5/06*** | (2006.01) |
| ***B65B 43/54*** | (2006.01) |
| ***B65B 63/02*** | (2006.01) |
| ***B65B 7/16*** | (2006.01) |
| ***B65B 39/02*** | (2006.01) |
| ***B65B 39/06*** | (2006.01) |

(Continued)

(52) U.S. Cl.

CPC ..... *B65B 39/02* (2013.01); *B65B 5/067* (2013.01); *B65B 39/06* (2013.01); *B65B 51/146* (2013.01); *B65B 35/40* (2013.01)

(58) Field of Classification Search

CPC ..... B65B 39/02; B65B 39/06–39/145; B65B 5/06–5/068; B65B 43/54

See application file for complete search history.

(56) References Cited

U.S. PATENT DOCUMENTS 2,057,460 A * 10/1936 Walter ..... B65B 39/02 53/258
3,206,913 A * 9/1965 Fleigher ..... B65B 43/36 53/385.1

(Continued)

FOREIGN PATENT DOCUMENTS

EP 0424718 A1 * 5/1991
FR 1353459 A * 2/1964

(Continued)

*Primary Examiner* — Hemant M Desai
*Assistant Examiner* — Tanzim Imam
(74) *Attorney, Agent, or Firm* — Hauptman Ham, LLP

(57) ABSTRACT

It is an object of the invention to provide packaging means for an absorbent article that allows an absorbent article group comprising multiple absorbent articles arranged in a thickness direction to be easily and efficiently housed in a packaging container. Specifically, a forcing member that forces an absorbent article group mounted on a mount member into a container fitted on a container fitting member and houses it therein, is provided on a forward direction of the mount member, and is constructed so that when moving forward it contacts only with the absorbent article group mounted on the mount member, stopping movement of the absorbent article group on the mount member, thereby allowing the absorbent article group whose movement has been stopped to be inserted and forced into the container fitted on the container fitting member through an opening.

9 Claims, 8 Drawing Sheets

(51) Int. Cl.
*B65B 51/14* (2006.01)
*B65B 35/40* (2006.01)

(56) References Cited

U.S. PATENT DOCUMENTS

| | | | | | |
|---|---|---|---|---|---|
| 4,219,989 | A * | 9/1980 | Andrews | B65B 5/045 | 53/257 |
| 4,679,379 | A * | 7/1987 | Cassoli | B65B 9/073 | 100/232 |
| 5,148,655 | A * | 9/1992 | Salinas | B26D 3/24 | 53/245 |
| 5,511,364 | A * | 4/1996 | Levi | B65B 5/067 | 53/258 |
| 2006/0059868 | A1* | 3/2006 | Melville | B65B 5/045 | 53/570 |
| 2008/0022636 | A1* | 1/2008 | Haschke | A22C 21/00 | 53/473 |
| 2013/0097976 | A1* | 4/2013 | Honegger | B65B 59/02 | 53/492 |
| 2013/0255199 | A1* | 10/2013 | Haschke | B65B 65/00 | 53/473 |

FOREIGN PATENT DOCUMENTS

| | | | |
|---|---|---|---|
| JP | S5737525 | A | 3/1982 |
| JP | S6013896 | B2 | 4/1985 |
| JP | 1-254504 | A | 10/1989 |
| JP | H01254504 | A1 * | 10/1989 |
| JP | H07156924 | A | 6/1995 |
| JP | H07156924 | A1 * | 6/1995 |

* cited by examiner (a)

(b)

PACKAGING APPARATUS AND PACKAGING METHOD FOR ABSORBENT ARTICLE

TECHNICAL FIELD

The present invention relates to a packaging apparatus and a packaging method by which an absorbent article, such as a urine-absorbing sheet for pets, or a disposable diaper, sanitary napkin or the like, is housed and packaged in a container such as a bag for sale.

BACKGROUND ART

Various types of absorbent articles, such as urine-absorbing sheets for pets or disposable diapers, sanitary napkins or the like, when they are sold as products, are usually packaged by being housed in multiple numbers in a container such as a polyethylene bag or the like.

When multiple absorbent articles are packaged, the multiple absorbent articles are arranged in the thickness direction as a group of absorbent articles, and the absorbent article group is inserted through the insertion opening of a packaging container to be housed in the container, after which the opening is sealed.

When an absorbent article group is packaged in this manner, usually a packaging apparatus such as illustrated in PTL 1, for example, is used to move a receptacle holding the absorbent article group near to the opening of the packaging container, and the absorbent article group in the receptacle is forced into the container through the opening using a forcing member.

However, the package described in PTL 1 has a construction in which a mounting stage on which the absorbent article group is mounted is moved to the position at the opening of the container, which is situated at a different position, the absorbent article group on the mounting stage then being forced into it with a forcing member, and therefore the position at which the absorbent article group has been mounted on the mounting stage and the position of the container in which the absorbent article group has been housed are in a greatly separated state.

Thus, an operator conducting packaging of an absorbent article group has been obliged to move the container in which the absorbent article group is housed after the absorbent article group has been mounted on the mounting stage, and the series of packaging operations has been very troublesome, from placing the absorbent articles on the mounting stage, and then to housing the absorbent article group in the container and recovering it. Furthermore, in order to promptly carry out this series of packaging operations there is a need for two persons, an operator to mount the absorbent article group on the mounting stage and an operator to recover the container in which the absorbent article group has been housed, and this leads to the problem of poor working efficiency.

CITATION LIST

Patent Literature

[PTL 1] Japanese Unexamined Patent Publication No. 1-254504

SUMMARY OF THE INVENTION

Technical Problems

The technical problem of the invention is to provide packaging means for an absorbent article that allows an absorbent article group comprising multiple absorbent articles arranged in the thickness direction to be easily and efficiently housed in a packaging container.

Solution to Problems

In order to solve this problem, the packaging apparatus for an absorbent article according to the invention is as follows.

(1) A packaging apparatus for an absorbent article, that inserts an absorbent article group comprising multiple absorbent articles arranged in a thickness direction, through an insertion opening of a packaging container to house the absorbent article group in the container, and seals the opening, wherein the packaging apparatus comprising a mount member that mounts the absorbent article group, a container fitting member on which the container is fitted, a forcing member that forces the absorbent article group mounted on the mount member into the container fitted onto the container fitting member, and a sealing member that seals the opening of the container in which the absorbent article group has been housed, the mount member being formed in a manner freely forward/backward movable in one direction, the container fitting member being fitted onto the back side of the mount member and being formed in a manner freely forward/backward movable together with the mount member, and having a construction allowing fitting of the container while directing the opening toward a forward direction and holding the container open in a prescribed shape, and the forcing member being provided on the forward direction of the mount member, and being contacted only with the absorbent article group mounted on the forward-moving mount member and to stop movement of the absorbent article group, while inserting and forcing the absorbent article group whose movement has been stopped, through the opening into the container fitted onto the container fitting member that is moving forward on the back side of the mount member, the sealing member is provided on the forward direction of the mount member, and freely seals the opening of the container into which the absorbent article group has been housed and which has been detached from the container fitting member.

(2) The packaging apparatus for an absorbent article according to (1) above, wherein the forcing member stops at a predetermined position in the forward direction of the mount member during the time when the forcing member is contacting with the absorbent article group until the absorbent article group is housed in the container, and after the absorbent article group has been housed in the container, the forcing member can be moved in a direction away from the container.

(3) The packaging apparatus for an absorbent article according to (1) or (2) above, wherein the forcing member maintains a stopped state of the absorbent article group, so that the container housing the absorbent article group is caused to detach from the forward-moving container fitting member at a location where the opening of the container is to be sealed by the sealing member.

(4) The packaging apparatus for an absorbent article according to any one of (1) to (3) above, wherein the mount member comprises a horizontal plate-shaped base section on a top surface of which the absorbent article group is mounted, and a first holding plate and a second holding plate that are provided at the base section at a predetermined spacing in the direction perpendicular to the forward/backward direction of the mount member, rising upward in a vertical direction and extending in the forward/backward direction of the mount member, and freely clamps the absorbent article group mounted on the base section between the first holding plate and the second holding plate, the first holding plate and the second holding plate both being set in a freely movable manner in a horizontal direction perpendicular to the forward/backward direction of the mount member, with the spacing between the first holding plate and the second holding plate being freely adjustable.

(5) The packaging apparatus for an absorbent article according to (4) above, wherein the mount member mounts the absorbent article group on the base section in a state such that the thickness direction of the absorbent article is facing the horizontal direction perpendicular to the forward/backward direction of the mount member, the first holding plate and second holding plate freely clamp the absorbent article group mounted on the base section, in a compressed state in the thickness direction of the absorbent article, and the forcing member inserts the absorbent article group compressed by the first holding plate and the second holding plate through the opening into the container that is fitted onto the container fitting member.

(6) The packaging apparatus for an absorbent article according to (4) or (5) above, wherein the container fitting member is provided with a first mounting plate and a second mounting plate that are mutually disposed at the base section on the back side of the mount member, at a predetermined spacing in the direction perpendicular to the forward/backward direction of the container fitting member, and formed in a plate-shaped manner rising upward and extending in the forward/backward direction of the container fitting member, for opening of the opening of the container to a prescribed shape, the first mounting plate and the second mounting plate both being set in a freely movable manner in the horizontal direction perpendicular to the forward/backward direction of the container fitting member, so that the spacing between the first mounting plate and second mounting plate is freely adjustable.

(7) The packaging apparatus for an absorbent article according to (6) above, wherein the container fitting member has the first mounting plate and the second mounting plate inserted into the container through the opening of the container, and fitted the container with the opening in a spread open state.

(8) The packaging apparatus for an absorbent article according to (6) or (7) above, wherein the first mounting plate of the container fitting member is at the edge of the first holding plate of the mount member on the back side of the mount member, with the plate surface of the first mounting plate and the plate surface of the first holding plate mutually connected so as to be even, while the second mounting plate of the container fitting member is at the edge of the second holding plate of the mount member on the back side of the mount member, with the plate surface of the second mounting plate and the plate surface of the second holding plate mutually connected so as to be even, and when the spacing between the first holding plate and the second holding plate has been adjusted, the spacing between the first mounting plate and the second mounting plate is also adjusted in synchronization.

(9) The packaging apparatus for an absorbent article according to any one of (1) to (8), wherein the packaging apparatus comprises a support member that supports the container in which the absorbent article is housed.

Also in order to solve the problem described above, the packaging method for an absorbent article according to the invention is as follows.

(10) A packaging method for an absorbent article, wherein an absorbent article group comprising multiple absorbent articles arranged in a thickness direction is inserted through an insertion opening of a packaging container to house the absorbent article group in the container, and the opening is sealed, the packaging method comprising:

a mounting step in which the absorbent article group is mounted on a mount member that has been formed in a freely forward/backward movable manner in one direction, a container fitting step in which the container is fitted onto a container fitting member, mounted on a back side of the mount member and formed in a freely forward/backward movable together with the mount member, while holding the opening open in a prescribed shape facing the forward direction, a stopping step in which the mount member moves forward, causing only the absorbent article group mounted on the mount member to contact with a forcing member disposed on a forward direction of the mount member, stopping movement of the absorbent article group, a housing step in which the container fitted onto the container fitting member that is moving forward on the back side of the mount member, houses the absorbent article group whose movement has been stopped, through the opening, and a sealing step in which the opening of the container in which the absorbent article group has been housed is sealed.

(11) The packaging method for an absorbent article according to (10) above, wherein:

the stopping step is carried out with the forcing member stopped at a predetermined position on the forward direction of the mount member, and the sealing step is carried out after the forcing member that has housed the absorbent article group in the container has moved in a direction away from the container.

(12) The packaging method for an absorbent article according to (10) or (11) above, wherein the housing step includes a step in which the forcing member maintains the stopped state of the absorbent article group, so that the container housing the absorbent article group is caused to detach from the forward-moving container fitting member at the location where the opening of the container is to be sealed by the sealing member.

(13) The packaging method for an absorbent article according to any one of (10) to (12) above, wherein the mounting step includes a clamping step in which the absorbent article group is clamped by the mount member while being compressed in the thickness direction of the absorbent articles, with the absorbent articles in a state with the thickness direction of the absorbent articles being oriented in a horizontal direction perpendicular to the forward/backward direction of the mount member.

(14) The packaging method for an absorbent article according to any one of (10) to (13), wherein in the container fitting step, the container fitting member is inserted into the container through the opening of the container, and the container is fitted onto the container fitting member while spreading open the opening in a prescribed shape by the container fitting member.

Advantageous Effects of Invention

According to the invention it is possible for a container fitted onto a container fitting member, which is moving forward on the back side of a mount member while the mount member is moving forward, to incorporate inside it an absorbent article group whose movement has been stopped by a forcing member, so that the absorbent article group is housed in the container with little movement.

This makes it possible to minimize the distance between the location where the absorbent article group is mounted on the mount member and the container location after it has housed the absorbent article group, while allowing the absorbent article group to be easily housed in the container, so that the series packaging operations of housing the absorbent article group in the container after the absorbent article group has been mounted on the mount member, up to the point of recovery, can be easily and efficiently carried out.

DESCRIPTION OF EMBODIMENTS

Figure 1:
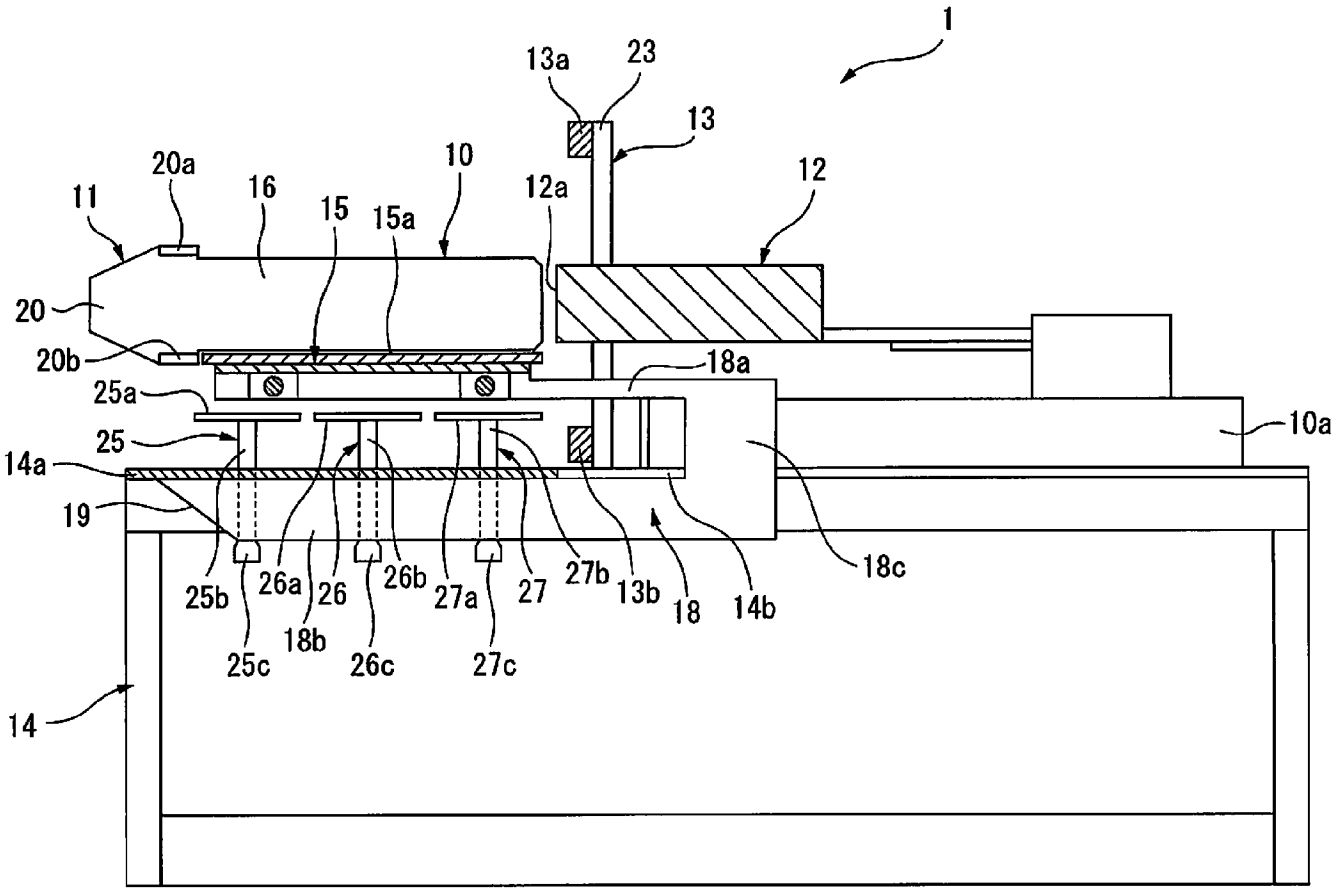
FIG. 1 is a side view schematically showing an embodiment of a packaging apparatus according to the invention.
Figure 2:
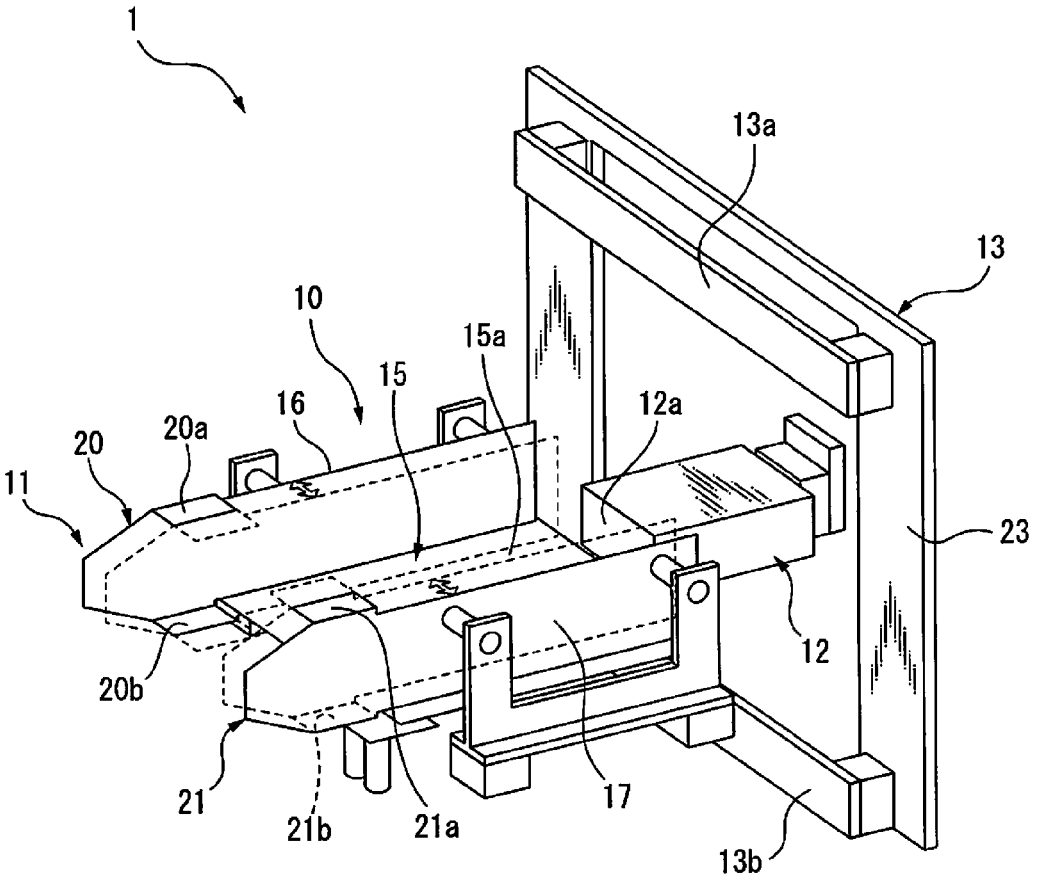
FIG. 2 is a plan view of the same.

FIG. 1 and FIG. 2 are illustrations of an embodiment of a packaging apparatus for an absorbent article according to the invention, the packaging apparatus 1 of this embodiment being one that packages a plurality of absorbent articles 2 by inserting an absorbent article group 3 of the absorbent articles 2 arranged in the thickness direction, through the insertion opening 5 of a packaging container 4, housing the absorbent article group 3 in the container 4 and sealing the opening 5.

Specifically, the packaging apparatus 1 of this embodiment comprises a mount member 10 that mounts the absorbent article group 3, a container fitting member 11 that fits the container 4, a forcing member 12 that forces the absorbent article group 3 mounted on the mount member 10 into the container 4 fitted on the container fitting member 11, and houses it, and a sealing member 13 that seals the opening 5 of the container 4 in which the absorbent article group 3 has been housed.

For this embodiment, the mount member 10 and the container fitting member 11, forcing member 12 and sealing member 13 are basically fitted on a carrier 14 having a horizontal, flat top plate 14*a*.

The absorbent articles 2 are pet urine-absorbing sheets, or disposable diapers, sanitary napkins or the like, and they each comprise a liquid-permeable top sheet, a liquid-impermeable back sheet and a liquid-absorbing absorbent body. For this embodiment, pet urine-absorbing sheets are used as the absorbent articles 2.

The absorbent articles 2 of this embodiment are pet urine-absorbing sheets that are essentially rectangular as viewed from the top sheet side, and essentially cuboid (essentially rectangular as viewed from the thickness direction) with a lengthwise direction and a widthwise direction, and a thickness direction, and a suitable size.

Also, the absorbent article group 3 is a bundle of absorbent articles 2, formed by arranging a plurality of absorbent articles 2 (pet urine-absorbing sheets in a folded state) in the thickness direction, the entirety being essentially cuboid and extending in the thickness direction of the absorbent articles 2.

The container 4 is formed of a flexible sheet material such as polypropylene, for example, and for this embodiment, the entirety is formed into an essentially cuboid shape, with one of the 6 faces being an essentially rectangular opening 5 that opens outward, for use as a bag. The absorbent article group 3 may also be housed and packaged as a pair.

The container does not necessarily need to be formed of a flexible material, and one having any shape, and formed of any suitable material such as a paper box, may be used so long as the absorbent articles (more strictly speaking, the absorbent article group) can be reliably and stably housed and packaged.

The mount member 10 is formed in a manner freely forward/backward movable in one direction.

More specifically, the mount member 10 is provided with a horizontal plate-shaped base section 15 on which the absorbent article group 3 is be mounted, and a first holding plate 16 and second holding plate 17 disposed on the base section 15, at a predetermined spacing in the direction perpendicular to the forward/backward direction of the mount member 10. For this embodiment, a moving member 18 that moves together with the base section 15 is provided on the bottom side of the base section 15.

Incidentally, this embodiment is designed so that when the mount member 10 is located on the moving edge in the backward direction, the operator conducting the packaging operation can mount the absorbent article group 3 on the base section 15. Furthermore, the packaging apparatus 1 is provided with driving means for forward/backward movement, and the driving means employed may be, for example, one having a forward/backward movement actuator such as fluid-pressure cylinder or electric motor (not shown), and a guide member 10*a* such as straight linear guide rail or the like that guides it linearly in the forward/backward direction, as shown in FIG. 1, as this will allow the mount member 10 to be moved forward and backward in a straight linear manner.

The base section 15 has a top surface serving as the mounting surface 15*a* on which the absorbent article group 3 is mounted, the mounting surface 15*a* being formed in a rectangular planar shape having a size allowing mounting of a plurality of absorbent article groups 3, the surface thereof being formed horizontal and flat.

The first holding plate 16 and second holding plate 17 are disposed on the mounting surface 15*a* of the base section 15, both being formed in a plate-shaped manner rising vertically upward and extending in the forward/backward direction of the mount member 10, and the absorbent article group 3 mounted on the base section 15 being freely clampable between the first holding plate 16 and the second holding plate 17. For this embodiment, the first holding plate 16 and the second holding plate 17 are formed in mutually equal sizes and shapes, the mutually facing plate surfaces being mutually parallel and flat.

Also, the first holding plate 16 and second holding plate 17 are both set in a freely movable manner linearly in the horizontal direction perpendicular to the forward/backward direction of the mount member 10, with the spacing between the first holding plate 16 and the second holding plate 17 being freely adjustable. Here, the first holding plate 16 and second holding plate 17 are freely movable while their mutually facing plate surfaces are kept in a parallel state.

Incidentally, for this embodiment, the first holding plate 16 and the second holding plate 17 move linearly in the horizontal direction perpendicular to the forward/backward direction of the mount member 10 by moving means which may be an actuator or the like, such as a fluid-pressure cylinder or an electric motor, allowing the spacing between them to be adjusted. Here, the first holding plate 16 and second holding plate 17 are movable while constantly maintaining the location of line symmetry, with the central axis in the widthwise direction of the mounting surface 15*a* of the base section 15 as the axis of symmetry.

Also, the mount member 10 is able to mount the absorbent article group 3 on the base section 15 in a state such that the thickness direction of the absorbent articles 2 is facing the horizontal direction perpendicular to the forward/backward direction of the mount member 10, and the first holding plate 16 and second holding plate 17 freely clamp the absorbent article group 3 mounted on the base section 15, in a compressed state in the thickness direction of the absorbent articles 2.

That is, since the absorbent articles 2 themselves which constitute the absorbent article group 3 all have excellent flexibility and are also folded, there is sufficient room for allowing compression, and therefore the absorbent article group 3 as a whole is compressed to some degree, reducing the overall bulk, and thereby facilitating insertion of the absorbent article group 3 into the container 4 through the opening 5.

Figure 3:
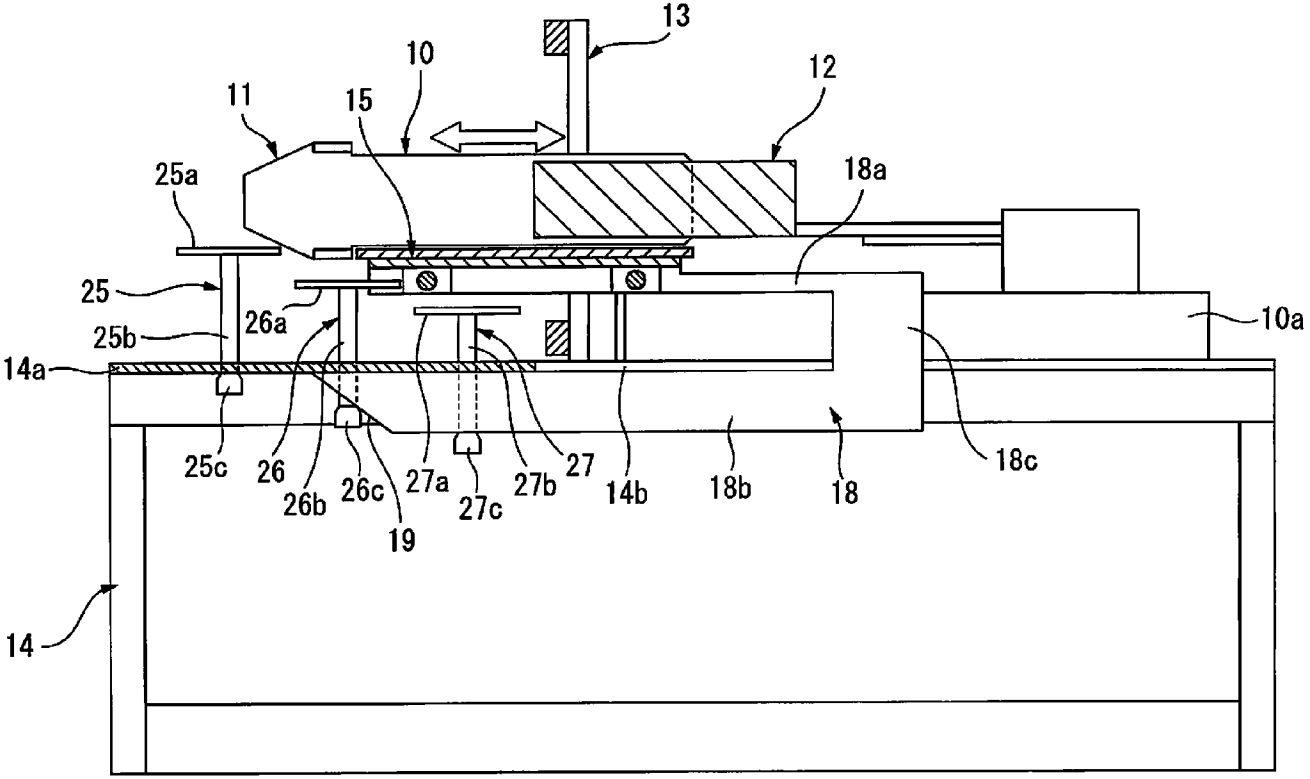
FIG. 3 is a side view schematically showing a state where the mount member has moved forward.

In addition, as shown in FIG. 1 and FIG. 3, the moving member 18 comprises an upper side member 18*a* extending in the forward/backward direction of the mount member 10, connected to the bottom side of the base section 15 and moving forward and backward over the top plate 14*a* of the carrier 14 together with the base section 15, a lower side member 18*b* extending in the forward/backward direction of the mount member 10, moving forward and backward below the top plate 14*a* of the carrier 14, and a connecting member 18*c* that connects together the forward-moving direction side of the mount member 10 of the upper side member 18*a* and the forward-moving direction side of the mount member 10 of the lower side member 18*b*. In the case of this embodiment, the actual construction is such that the moving member 18 is connected to an actuator and the moving member 18 is moved forward and backward by the actuator to allow forward/backward movement of the base section 15.

Also according to this embodiment, the connecting member 18*c* is fitted on the guide member 10*a* in a freely sliding manner in the lengthwise direction of the guide member 10*a*, whereby the base section 15 and the moving member 18 as a whole are capable of linear forward/backward movement. Also, a portion of the lower side member 18*b* side of the connecting member 18*c* moves inside the groove of a through-groove 14*b* extending in the forward/backward direction of the mount member 10, that is provided running through the top plate 14*a* of the carrier 14 in the thickness direction of the top plate 14*a*.

Also, the lower side member 18*b* is capable of forward/backward movement along the bottom side of the top plate 14*a* of the carrier 14, and on the bottom end face of the lower side member 18*b*, engaging members 25*c* to 27*c* of support members 25 to 27, described below, can engage with the bottom end face of the lower side member 18*b* in a freely sliding manner.

The container fitting member 11 is fitted on the back side of the mount member 10, and is formed so as to be freely forward/backward movable together with the mount member 10 (i.e. freely forward/backward movable in the same direction as the forward/backward direction of the mount member 10). Also, the container fitting member 11 is constructed so as to be fittable while holding the container 4 with its opening 5 open toward the forward direction and in a prescribed shape.

Specifically, the container fitting member 11 of this embodiment is provided with a first mounting plate 20 and a second mounting plate 21 that are mutually disposed at the back side of the mount member 10 of the base section 15, at a predetermined spacing in the direction perpendicular to the forward/backward direction of the container fitting member 11, and formed in a plate-shaped manner rising upward and extending in the forward/backward direction of the container fitting member 11, for opening of the opening 5 of the container 4 to a prescribed shape (which is essentially rectangular in this embodiment).

Also, the first mounting plate 20 and second mounting plate 21 are both set in a freely movable manner in the horizontal direction perpendicular to the forward/backward direction of the container fitting member 11, with the spacing between the first mounting plate and the second mounting plate being freely adjustable.

Furthermore, in this embodiment, the first mounting plate 20 and second mounting plate 21 are inserted into the container 4 through the opening 5 of the container 4, and it is possible to fit the container 4 onto the container fitting member 11, with the opening 5 in a spread open state. That is, the construction is such that when the first mounting plate 20 and the second mounting plate 21 are in a state inserted into the container 4 through the opening 5 of the container 4, the distance between the first mounting plate 20 and the second mounting plate 21 is expanded to spread open the opening 5 of the container 4 in an essentially rectangular manner, while simultaneously holding the container 4 on the container fitting member 11.

For this embodiment, the first mounting plate 20 and the second mounting plate 21 are formed in mutually equal sizes and shapes, the mutually facing plate surfaces being mutually parallel and flat, allowing the opening 5 of the container 4 to be spread open in an essentially rectangular manner. That is, depending on the heights of the first mounting plate 20 and the second mounting plate 21, the opening 5 of the container 4 is spread in a straight linear manner in the up-down direction, allowing formation of the short side sections of the opening 5 that is to have an essentially rectangular form.

Consequently, after that point, by expanding the region between the first mounting plate 20 and the second mounting plate 21, the opening 5 can be pulled in the horizontal direction and can form the long side sections of the opening 5 that is to have an essentially rectangular form, and therefore the container fitting member 11 can form the opening 5 as a whole into an essentially rectangular shape of a prescribed size.

Incidentally, the first mounting plate 20 and second mounting plate 21 have fitted, at their respective top edge sections, essentially horizontal upper control plates 20*a*, 21*a* extending in the other mounting plate direction. The upper control plates 20*a*, 21*a* provide support so that the upper edge of the opening 5 of the container 4 fitted on the container fitting member 11 does not sag, while guiding the absorbent article group 3 inserted into the container 4 through the opening 5 so as to prevent the individual absorbent articles 2 from being pushed out upward and escaping out, and allowing the absorbent article group 3 as a whole to be stably forced into the container 4.

In addition, at the respective lower edge sections of the first mounting plate 20 and second mounting plate 21, there are fitted essentially horizontal lower control plates 20*b*, 21*b*, extending in the other mounting plate direction. The lower control plates 20*b*, 21*b* are set at locations so that their edges on the lower side of the opening 5 of the container 4 are at roughly the same height as, or slightly lower than, the mounting surface 15*a* of the base section 15 of the mount member 10, so that the absorbent article group 3 is smoothly and stably inserted through the opening 5 of the container 4.

The container fitting member 11 of this embodiment has the first mounting plate 20 mutually connected in an integral manner to the edge of the first holding plate 16 of the mount member 10 on the back side of the mount member 10, so that the plate surface of the first mounting plate 20 and the plate surface of the first holding plate 16 (more specifically, the plate surfaces on the side facing the second mounting plate 21 or second holding plate 17) are even.

Also, the second mounting plate 21 of the container fitting member 11 is mutually connected in an integral manner to the edge of the second holding plate 17 of the mount member 10 on the back side of the mount member 10, so that the plate surface of the second mounting plate 21 and the plate surface of the second holding plate 17 (more specifically, the plate surfaces on the side facing the first mounting plate 20 or second holding plate 17) are even.

When the first holding plate 16 and second holding plate 17 of the mount member 10 move horizontally in the direction perpendicular to the forward/backward direction of the mount member 10, adjusting the spacing between the first holding plate 16 and the second holding plate 17, the first mounting plate 20 and second mounting plate 21 move in the direction perpendicular to the forward/backward direction of the container fitting member 11 (that is, the forward/backward direction of the mount member 10) together with the movement of the first holding plate 16 and second holding plate 17, so that the spacing between the first mounting plate 20 and the second mounting plate 21 is also adjusted in synchronization. In other words, the container fitting member 11 is formed in an essentially integral manner with the mount member 10.

Consequently, the first mounting plate 20 of the container fitting member 11 and the first holding plate 16 of the mount member 10 move integrally, while the second mounting plate 21 of the container fitting member 11 and the second holding plate 17 of the mount member 10 also move integrally. Therefore, the first mounting plate 20 and the second mounting plate 21 move by the aforementioned moving means used to move the first holding plate 16 and second holding plate 17, provided on the mount member 10, which moving means is an actuator or the like, such as a fluid-pressure cylinder or electric motor, allowing adjustment of the spacing between the first mounting plate 20 and the second mounting plate 21.

For this embodiment, the distance between the first mounting plate 20 and the second mounting plate 21 of the container fitting member 11 and the distance between the first holding plate 16 and the second holding plate 17 of the mount member 10 are always the same.

This eliminates the need to provide separate means for movement of the first mounting plate 20 and the second mounting plate 21 in the container fitting member 11, thereby not only allowing space reduction but also facilitating coordination of movement of the container fitting member 11 with that of the mount member 10.

In particular, since the first mounting plate 20 and the second mounting plate 21 can be moved in coordination with movement of the first holding plate 16 and the second holding plate 17 of the mount member 10, and advantage is provided in that holding of the absorbent article group 3 and fitting of the container 4, as well as insertion of the absorbent article group 3 into the container 4, can be accomplished in a smooth manner.

That is, since the distance between the first mounting plate 20 and the second mounting plate 21 can be reduced when the first holding plate 16 and second holding plate 17 of the mount member 10 are in a state of having adjusted and compressed the absorbent article group 3 in the thickness direction of the absorbent articles 2, the size is such that the first mounting plate 20 and second mounting plate 21 are easily inserted into the opening 5 of the container 4.

Furthermore, when the first mounting plate 20 and second mounting plate 21 have spread open the opening 5 of the container 4 in an essentially rectangular manner, the distance between the first mounting plate 20 and the second mounting plate 21 are widened to some extent, and the distance between the first holding plate 16 and the second holding plate 17 of the mount member 10 is also increased. This reduces the compressive force on the absorbent article group 3, thereby allowing the absorbent article group 3 to be kept in a compressed state of sufficient size for insertion into the opening 5 of the container 4, while facilitating movement of the absorbent article group 3 on the mounting surface 15*a* of the base section 15, for insertion and forcing through the opening 5 of the container 4 by the forcing member 12, and allowing that movement to be accomplished smoothly.

Consequently, the first mounting plate 20 and second mounting plate 21, and the first holding plate 16 and second holding plate 17 of the mount member 10, can be smoothly moved in mutual coordination, from holding of the absorbent article group 3 until fitting of the container 4 and insertion of the absorbent article group 3 into the container 4.

In addition, since the plate surface of the first mounting plate 20 and the plate surface of the first holding plate 16 are mutual connected in an even manner and the plate surface of the second mounting plate 21 and the plate surface of the second holding plate 17 are mutually connected in an even manner, when the absorbent article group 3 is inserted toward the opening 5 of the container 4 on the mounting surface 15*a* of the base section 15, the absorbent articles 2 of the absorbent article group 3 are caused to smoothly slide to allow movement of the absorbent article group 3 as a whole to be accomplished in a smooth and stable manner.

The forcing member 12 is provided on the forward direction of the mount member 10, and contacts only with the absorbent article group 3 mounted on the mount member 10 during forward movement, allowing movement of the absorbent article group 3 to be blocked and stopped.

The absorbent article group 3 whose movement has been stopped can then be inserted and forced through the opening 5 into the container 4 fitted on the container fitting member 11 that is moving forward on the back side of the mount member 10.

For this embodiment, the forcing member 12 is formed as an essentially cuboid shape overall, and the end face on the side facing the mount member 10 forms a contact surface 12*a* that contacts with the absorbent article group 3 mounted on the mounting surface 15*a* of the base section 15 of the mount member 10.

The bottom side end face of the forcing member 12 is situated higher than the mounting surface 15*a* of the base section 15, in a range allowing stable contact with the absorbent article group 3 mounted on the mounting surface 15*a* of the base section 15 of the mount member 10, thereby allowing forward movement to continue onward, passing the bottom side of the forcing member 12, on the mount member 10.

Furthermore, the forcing member 12 stops at a predetermined position on the forward direction of the mount member 10 when it contacts with the absorbent article group 3, until the absorbent article group 3 is housed in the container 4, and after the absorbent article group 3 has been housed in the container 4, it can move in the direction away from the container 4, and specifically the opposite direction from the contact surface 12*a* of the forcing member 12.

In addition, the forcing member 12 maintains the stopped state of the absorbent article group 3, thereby allowing the container 4 in which the absorbent article group 3 has been housed to detach from the forward-moving container fitting member 11 at the location where the opening 5 of the container 4 is sealed by the sealing member 13.

Thus, the absorbent article group 3 on the base section 15 of the mount member 10 has its movement stopped by contact with the forcing member 12 which is at the location where the opening 5 of the container 4 has been sealed by the sealing member 13, while the mount member 10 including the base section 15 still continues to move forward, and therefore the actual position of the absorbent article group 3 whose movement has been blocked by the forcing member 12 does not move, although its position relative to the mount member 10 changes. This causes the absorbent article group 3 to relatively move on the back side of the mount member 10 while sliding over the base section 15.

Moreover, the container fitting member 11 that is located on the back side of the mount member 10, along with forward movement of the mount member 10, approaches the absorbent article group 3 whose movement has stopped, and the container 4 fitted on the container fitting member 11 takes in and houses the absorbent article group 3 through the opening 5.

Furthermore, since the container fitting member 11 continues its forward movement even after the absorbent article group 3 has been housed in the container 4, the forcing member 12 that has not moved from that position actually forces the absorbent article group 3 into the container 4, and after it has forced the absorbent article group 3 into the innermost part of the container 4, it blocks movement of the container 4 through the absorbent article group 3 with which it contacts. Due to the forcing member 12, therefore, the container 4 is pulled out from the first mounting plate 20 and the second mounting plate 21 of the container fitting member 11, and movement of the container 4 also stops at that position, or more specifically, the position where the opening 5 of the container 4 is to be sealed by the sealing member 13.

In addition, the forcing member 12 moves in the direction away from the container 4, i.e. in the opposite direction from the contact surface 12*a* of the forcing member 12, and moves back to a position that does not interfere with operation of the sealing member 13.

Thus, the forcing member 12 has both the functions of forcing of the absorbent article group 3 into the container 4 and removal of the container 4 from the container fitting member 11 at the location where the opening 5 of the container 4 is sealed by the sealing member 13.

Here, the forcing member 12 is able to insert the absorbent article group 3, that has been compressed by the first holding plate 16 and second holding plate 17 of the mount member 10, through the opening 5 into the container 4 that has been fitted onto the container fitting member 11.

Thus, the length of the forcing member 12 in the horizontal direction is of such a size that the first mounting plate 20 and second mounting plate 21, and the first holding plate 16 and second holding plate 17 of the mount member 10, are nearly adjacent without contacting, when the container fitting member 11 has the opening 5 of the container 4 in a spread open state. This produces appropriate contact with the absorbent article group 3 that is in a compressed state between the first holding plate 16 and the second holding plate 17 of the mount member 10, so that the compressed absorbent article group 3 as a whole can be reliably and stably housed in the container 4 without separation between the absorbent articles 2.

Furthermore, the location where the forcing member 12 contacts with the absorbent article group 3 that is mounted on the mount member 10 will depend on the location of the sealing member 13, but preferably it is as close as possible to the backward moving edge of the mount member 10, i.e. the location where the operator mounts the absorbent article group 3 on the mount member 10, and preferably the forcing member 12 contacts with the absorbent article group 3 and inserts the absorbent article group 3 into the container 4 at a stage where the forward moving distance of the mount member 10 is small.

This will allow the location where the absorbent article group 3 is mounted on the mount member 10 by the operator, and the location where the container 4 in which the absorbent article group 3 is housed is to be sealed, to be as close as possible to each other, thereby allowing the operator that has mounted the absorbent article group 3 on the mount member 10 to recover the container 4 that has completed sealing, from the same location. As a result, after the absorbent article group 3 has been mounted on the mount member 10, it will be possible to rapidly, easily and efficiently carry out the series of packaging operations from housing of the absorbent article group 3 in the container 4 to its recovery.

Incidentally, forward/backward movement of the forcing member 12 (movement to the location where the opening 5 of the container 4 is to be sealed by the sealing member 13, and movement to a location where the operation of the sealing member 13 is not hindered), is accomplished by moving means such as a fluid-pressure cylinder or electric motor, but the distance of forward/backward movement of the forcing member 12 by the moving means is preferably as small as possible, and the moving distance is preferably as short as possible. Thus, since the procedure after the container 4 has been detached from the container fitting member 11 until sealing of the container 4 by the sealing member 13 can be carried out in a short time, it is possible to further shorten the packaging operation.

The sealing member 13 is disposed on the forward-moving direction side of the mount member 10 (as seen from the backward moving edge), and freely seals the opening 5 of the container 4 in which the absorbent article group 3 is housed and which has detached from the container fitting member 11.

For this embodiment, the sealing member 13 is provided with an upper and lower pair of heat welding members 13*a*, 13*b*, and by clamping from above and below the area near the opening edges of the opening 5 of the container 4 removed from the container fitting member 11 and detached from the forcing member 12, the section of the container 4 near the combined opening edges is bonded by heat welding, allowing the opening 5 to be sealed.

In regard to the upper and lower pair of heat welding members 13*a*, 13*b*, after fitting onto the support frame 23 extending upward and detachment of the forcing member 12, the upper heat welding member 13*a* is lowered while the lower heat welding member 13*b* is raised, such that the opening 5 is sealed at the center section in the thickness direction of the container 4 in which the absorbent article group 3 has been housed.

Incidentally, the packaging apparatus 1 of this embodiment comprises support members 25 to 27 that support the container in which the absorbent article group 3 (strictly speaking, the absorbent articles 2) has been housed.

The support members 25 to 27 serve as support to prevent falling of the container 4 when the container 4 has detached from the mount member 10 and the container fitting member 11, as the mount member 10 and the container fitting member 11 continue to move forward even after the absorbent article group 3 has been inserted into the container 4 by the forcing member 12.

For this embodiment, first to third support members 25 to 27 are provided in that order from the backward moving edge of the mount member 10, rising in order upward depending on the location of the mount member 10, so as to support the container 4. These first to third support members 25 to 27 each comprise top plates 25*a* to 27*a* that are flat on the top side and extend in the horizontal direction, and columnar support bars 25*b* to 27*b* extending in the vertical direction that support the respective top plates 25*a* to 27*a*, and an elastic member (not shown) that energizes the support bars 25*b* to 27*b* in the upward direction. In addition, they comprise engaging members 25*c* to 27*c* that are provided on the bottom end sides of the support bars 25*b* to 27*b* of the first to third support members 25 to 27, and are able to engage and be caught up on the bottom end face of the lower side member 18*b* of the moving member 18 of the mount member 10. These engaging members 25*c* to 27*c*, when the moving member 18 has moved forward and backward, slide along the bottom end face of the lower side member 18*b*, so that only forward/backward movement of the lower side member 18*b* is produced.

Incidentally, the support bars 25*b* to 27*b* run through the top plate 14*a* of the carrier 14 in the thickness direction, and are freely raisable in the direction essentially vertical to the thickness direction of the top plate 14*a*.

Furthermore, as shown in FIG. 1 and FIG. 3, regarding the first to third support members 25 to 27, when the mount member 10 is located on the backward moving edge, i.e. when the operator mounts the absorbent article group 3 on the base section 15 of the mount member 10, the engaging members 25*c* to 27*c* engage with the bottom end face of the lower side member 18*b* of the moving member 18 of the mount member 10, such that all of the support bar materials 25*b* to 27*b* are pushed downward by the thickness of the lower side member 18*b* (the length in the up-down direction). Thus, the first to third support members 25 to 27, and particularly the top plates 25*a* to 27*a*, become lowered to a location such that they do not contact with the base section 15, etc. of the mount member 10.

Furthermore, when the mount member 10 moves forward the moving member 18 also moves forward with it, but the slanted surface of the slanted section 19 that is provided behind the lower side member 18*b* of the moving member 18 (the backward moving side thereof) and gradually slopes upward toward the back side, reaches each of the locations of the engaging members 25*c* to 27*c* as the mount member 10 moves forward. Here, as shown in FIG. 3, the engaging members 25*c* to 27*c* gradually move upward by the elastic force of the elastic member, according to the slope of the slanted section 19, and therefore the support bars 25*b* to 27*b* move upward in order, the top plates 25*a* to 27*a* contacting with the bottom face of the container 4 in which the absorbent article group 3 has been housed, thereby allowing stable support so that the container 4 does not fall down from the packaging apparatus 1, or so that the container 4 does not lose balance and the absorbent articles 2 housed in the container 4 do not escape through the opening 5.

When the mount member 10 moves forward, the first support member 25 rises first, and then the second support member 26 and the third support member 27 rise in order. Also, the rising limit for the first to third support members 25 to 27 is approximately the same height as the base section 15 of the mount member 10, at which time the top surfaces of the top plates 25*a* to 27*a* are all at approximately the same height.

On the other hand, when the mount member 10 moves backward, that is, when the mount member 10 reaches the forward moving edge and the container that has completed housing of the absorbent article group 3 and sealing has been recovered, after which the mount member 10 is restored to the location where the operator mounts the absorbent article group 3 on the base section 15 of the mount member 10, the slanted surface of the slanted section 19 of the moving member 18 of the mount member 10 is engaged with the engaging members 25*c* to 27*c*, pushing the engaging members 25*c* to 27*c* downward in order, so that the first to third support members 25 to 27 fall down as a whole, moving to a location that does not interfere with backward movement of the mount member 10.

When the mount member 10 moves backward, the third support member 27 falls first, after which the second support member 26 and the first support member 25 fall in order.

A case of carrying out an embodiment of the packaging method of the invention will now be explained using a packaging apparatus for an absorbent article 1 having the construction described above.

In the packaging method of the invention, an absorbent article group comprising multiple absorbent articles arranged in the thickness direction is inserted through the insertion opening of a packaging container to house the absorbent article group in the container, and the opening is then sealed. Also, the packaging method basically comprises carrying out in order a mounting step S1 in which the absorbent article group 3 is mounted, a container fitting step S2, a stopping step S3 in which movement of the absorbent article group 3 is stopped by the forcing member 12, a housing step S4 in which the absorbent article group 3 is housed in the container 4, and a sealing step S5 in which the opening 5 of the container 4 is sealed.

As a preparation step, the individual absorbent articles that are to be packaged are produced and folded to an appropriate size for housing in the container 4. Also, an absorbent article group 3 is formed by creating a single bundle of a plurality of absorbent articles 2 arranged in the thickness direction.

A known production method may be used to produce the individual absorbent articles that are to be packaged.

The mounting step S1 is carried out after the preparation step.

In the mounting step S1, the absorbent article group 3 is mounted on the mount member 10 formed in a freely forward/backward movable manner in one direction.

Figure 4:
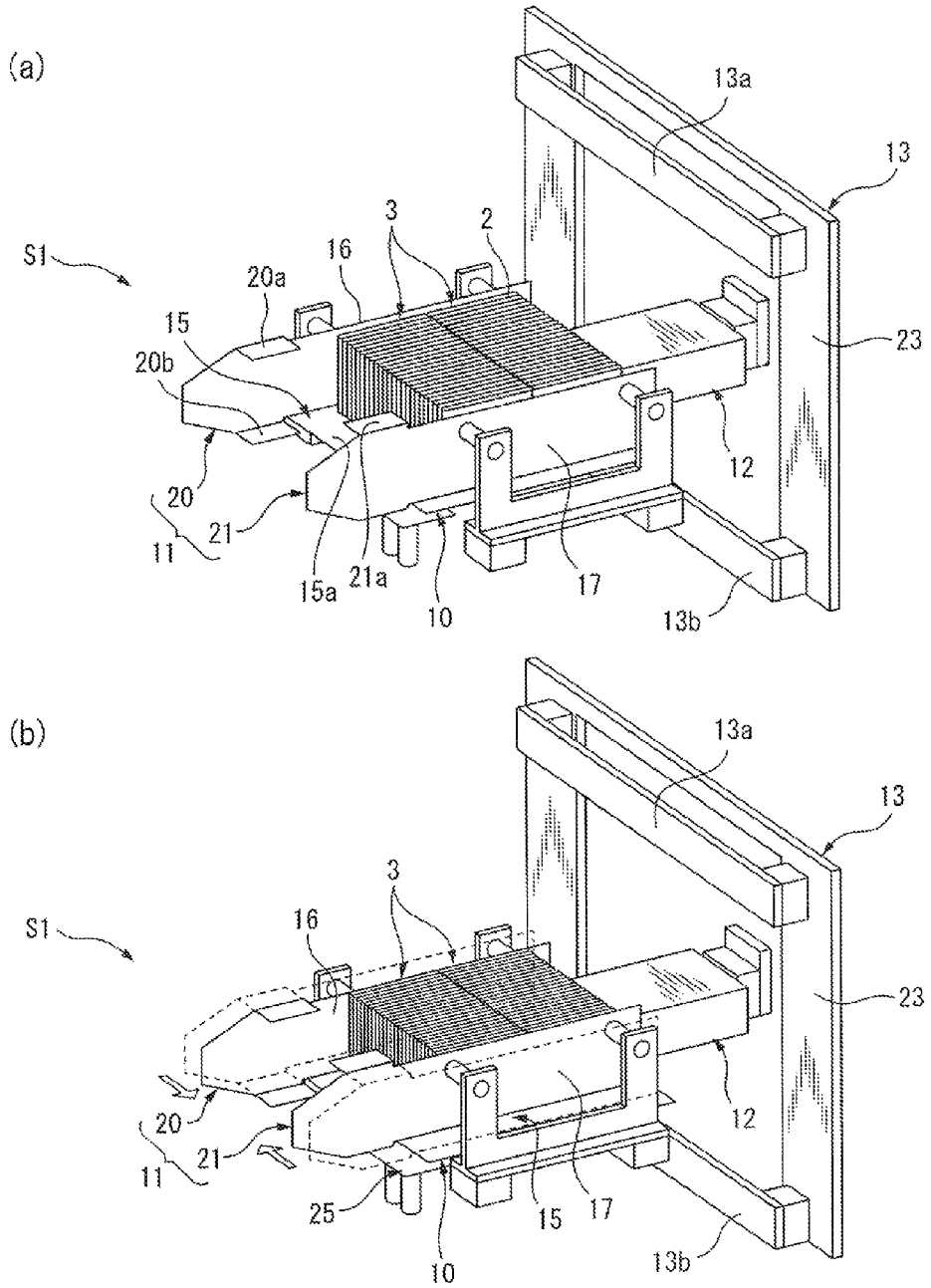
FIG. 4 is a plan view schematically showing a state of carrying out the mounting step of the packaging method of the invention. Here, (a) shows the state where the absorbent article group has been mounted, and (b) shows the state where the absorbent article group has been compressed.

Specifically, as shown in FIG. 4(*a*), the operator mounts the absorbent article group 3 in the space between the first holding plate 16 and the second holding plate 17, on the horizontal mounting surface 15*a* of the base section 15 of the mount member 10.

For this embodiment, mounting on the base section 15 is so that the state of the absorbent article group 3 with the thickness direction of the absorbent articles 2 is aligned in the direction perpendicular to the mount member 10, that is, the state where the absorbent articles 2 situated at both ends in the thickness direction of the absorbent articles 2 of the absorbent article group 3 are facing the first holding plate 16 or second holding plate 17 of the mount member 10. In this state, the distance between the first holding plate 16 and the second holding plate 17 is sufficiently larger than the size in the thickness direction of the absorbent articles 2 of the absorbent article group 3, so that the first holding plate 16 or second holding plate 17 does not interfere with mounting of the absorbent article group 3.

Also in this embodiment, a pair of absorbent article groups 3 are mounted, and more specifically, they are mounted side by side in the forward/backward direction of the mount member 10.

In mounting step S1, as shown in FIG. 4(*b*), a clamping step is carried out in which the absorbent article groups 3 mounted on the base section 15 are clamped while the absorbent article groups 3 are compressed in the thickness direction of the absorbent articles 2 by the mount member 10, with the thickness direction of the absorbent articles 2 oriented in the horizontal direction perpendicular to the forward/backward direction of the mount member 10.

Specifically, the first holding plate 16 and second holding plate 17 of the mount member 10 are moved to reduce the distance between the first holding plate 16 and the second holding plate 17, thereby compressing the absorbent article groups 3 in the thickness direction of the absorbent articles 2 and clamping them by the first holding plate 16 and second holding plate 17. This can compress the absorbent article groups 3 as a whole to some extent to reduce the overall bulk, and thus facilitate insertion of the absorbent article groups 3 into the container 4 through the opening 5.

The degree of compression of the absorbent article groups 3 may be set as desired within a range that allows the thickness to be restored after compression, but basically it may be such as to ensure a spacing between the first mounting plate 20 and the second mounting plate 21 that allows the first mounting plate 20 and second mounting plate 21 of the container fitting member 11 to be easily inserted into the opening 5 of the container 4 in the subsequent container fitting step S2, and the degree of compression is set by the spacing between the first holding plate 16 and the second holding plate 17, depending on that ensured spacing.

The container fitting step S2 is carried out after completion of the mounting step S1.

In the container fitting step S2, the container 4 is mounted on the container fitting member 11 that is fitted on the back side of the mount member 10 and formed in a manner freely forward/backward movable together with the mount member 10, while holding the opening 5 open in a prescribed shape (essentially rectangular in this case) facing the forward direction of the container fitting member 11 (that is, the forward direction of the mount member 10).

Figure 5:
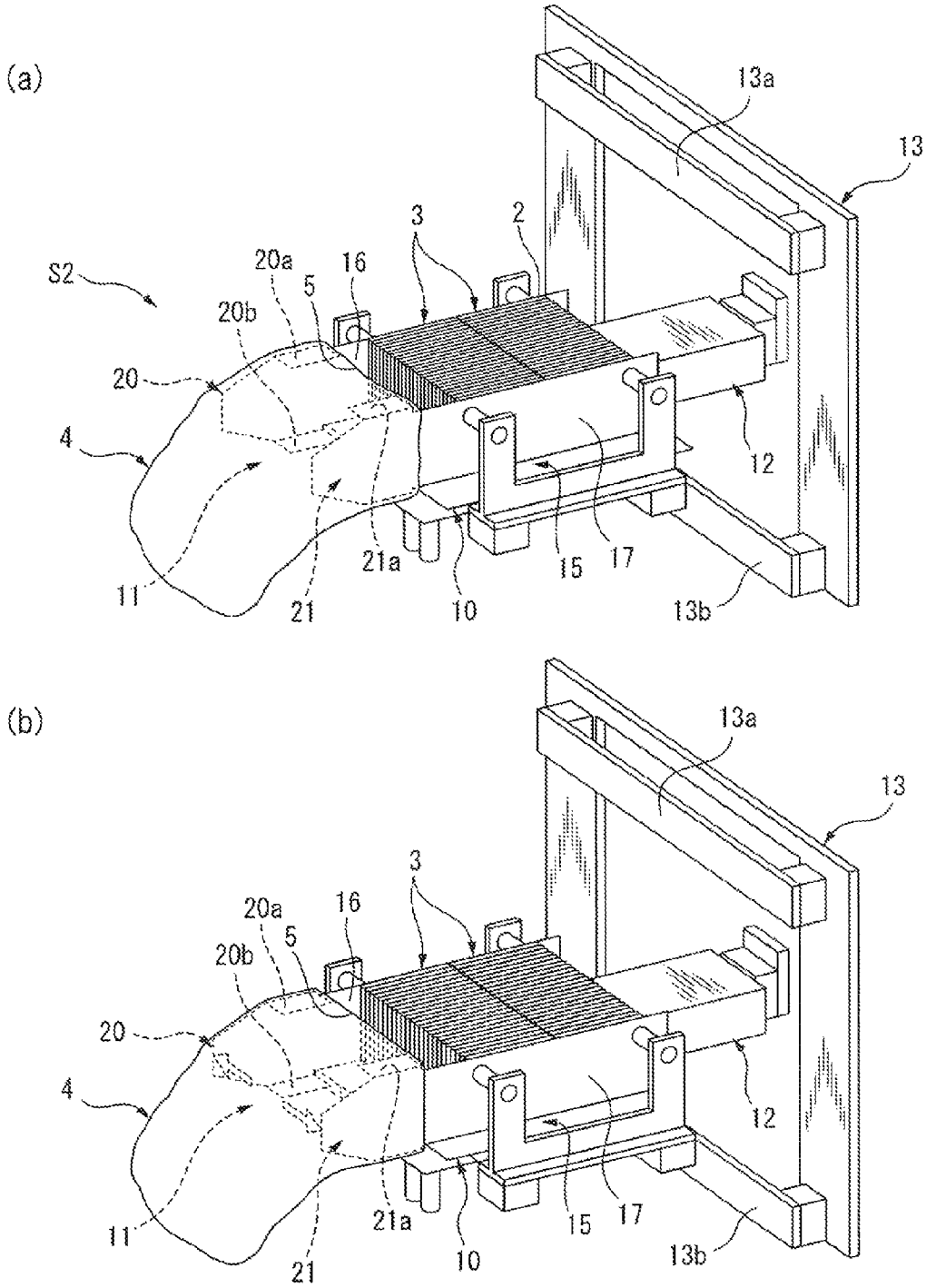
FIG. 5 is a plan view schematically showing a state of carrying out the container fitting step of the packaging method of the invention. Here, (a) shows the state where the container has been fitted onto the container fitting member, and (b) shows the state where the opening of the container has been spread open.

Specifically, in the container fitting step S2, it is fitted on the first mounting plate 20 and second mounting plate 21 of the container fitting member 11 with the container 4 inserted into the container 4 through the opening 5, as shown in FIG. 5(*a*). Because the distance between the first holding plate 16 and the second holding plate 17 is reduced by compression of the absorbent article groups 3 by the first holding plate 16 and second holding plate 17 of the mount member 10 in the mounting step S1, the spacing between the first mounting plate 20 and the second mounting plate 21 at this time is such that the distance between the first mounting plate 20 and the second mounting plate 21 at the container fitting member 11 is smaller than the essentially rectangular size planned for the opening 5 of the container 4 in the horizontal direction. Thus, the container 4 can be easily fitted on the first mounting plate 20 and the second mounting plate 21 through the opening 5.

In addition, in the container fitting step S2, after the container 4 has been fitted on the container fitting member 11, the spacing between the first mounting plate 20 and the second mounting plate 21 that have been inserted into the container 4 is expanded, thereby spreading open the opening 5 of the container 4 into an essentially rectangular shape of the planned size, while fitting the container 4 on the container fitting member 11 with the opening edges of the opening 5 held to some degree of tension, and that state is maintained, as shown in FIG. 5(*b*).

Consequently, by expanding the region between the first mounting plate 20 and the second mounting plate 21, the opening 5 can be pulled in the horizontal direction and can form the long side sections of the opening 5 that is to have an essentially rectangular form, and therefore the container fitting member 11 can form the opening 5 as a whole into an essentially rectangular shape of a prescribed size.

This holds the opening 5 in a rectangular shape of appropriate size and in a state with the opening edges held to some degree of tension, so that in the subsequent step, the absorbent article group 3 can be easily inserted into the container 4 through the opening 5 that is pushed open in an essentially rectangular shape, and so that the absorbent article group 3 can be smoothly and stably housed in the container 4.

By expanding the spacing between the first mounting plate 20 and the second mounting plate 21, the spacing between the first holding plate 16 and the second holding plate 17 of the mount member 10 is also increased, but the spacing between the first holding plate 16 and the second holding plate 17 is smaller than the size of the opening 5 of the container 4 in the horizontal direction, by the plate thicknesses of the first mounting plate 20 and the second mounting plate 21. Furthermore, while the degree of compression of the absorbent article groups 3 is somewhat reduced in this state, a compressed state of the absorbent articles 2 in the thickness direction is still maintained. Thus, a state is still maintained in which the absorbent article groups 3 are easy to insert into the container 4.

After the container fitting step S2, the stopping step S3 is carried out in which movement of the absorbent article groups 3 is stopped.

Figure 6:
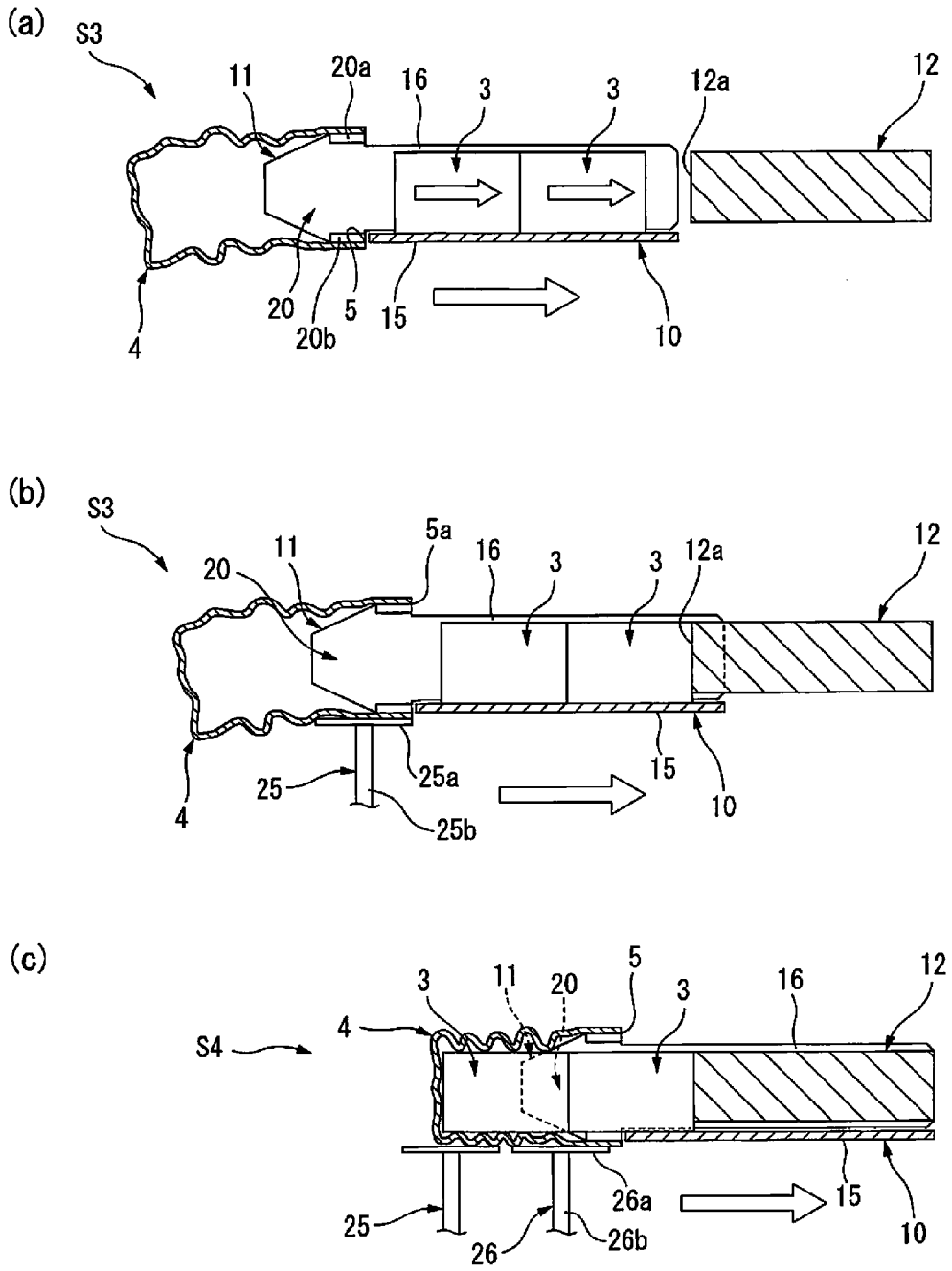
FIG. 6 is (a) a main cross-sectional view showing the state where the mount member has moved forward in the step of stopping movement of the absorbent article group, (b) a main cross-sectional view showing the state where the forcing member has stopped movement of the absorbent article group in the step of stopping movement of the absorbent article group, and (c) a main cross-sectional view showing the state where the forcing member has forced the absorbent article group into the container by forward movement of the mount member in the housing step, for the packaging method of the invention.

In the stopping step S3, as shown in FIG. 6(*a*) and FIG. 6(*b*), the mount member 10 is moved forward, with only the absorbent article groups 3 mounted on the mount member 10 contacting the forcing member 12 situated on the forward direction of the mount member 10, and movement of the absorbent article groups 3 is stopped.

Here, the forcing member 12 stops at a location such that the container 4 in which housing of the absorbent article groups 3 has been completed can stop at the position where the opening 5 is to be sealed by the sealing member 13. Also, as shown in FIG. 6(*b*), the forcing member 12 enters into the space between the first holding plate 16 and the second holding plate 17 on the base section 15 along with forward movement of the mount member 10, while they are in a state of non-contact with the base section 15 or with the first holding plate 16 and second holding plate 17, and the contact surface 12*a* stops movement of the pair of absorbent article groups 3 by contacting with the absorbent article group 3 located on the forward-moving direction side of the mount member 10 among the pair of absorbent article groups 3.

As a result, the absorbent article groups 3 on the base section 15 of the mount member 10 contact with the forcing member 12 and stops moving.

After the stopping step S3 in which movement of the absorbent article group 3 is stopped, the housing step S4 is carried out in which the absorbent article groups 3 are housed in the container 4.

Figure 7:
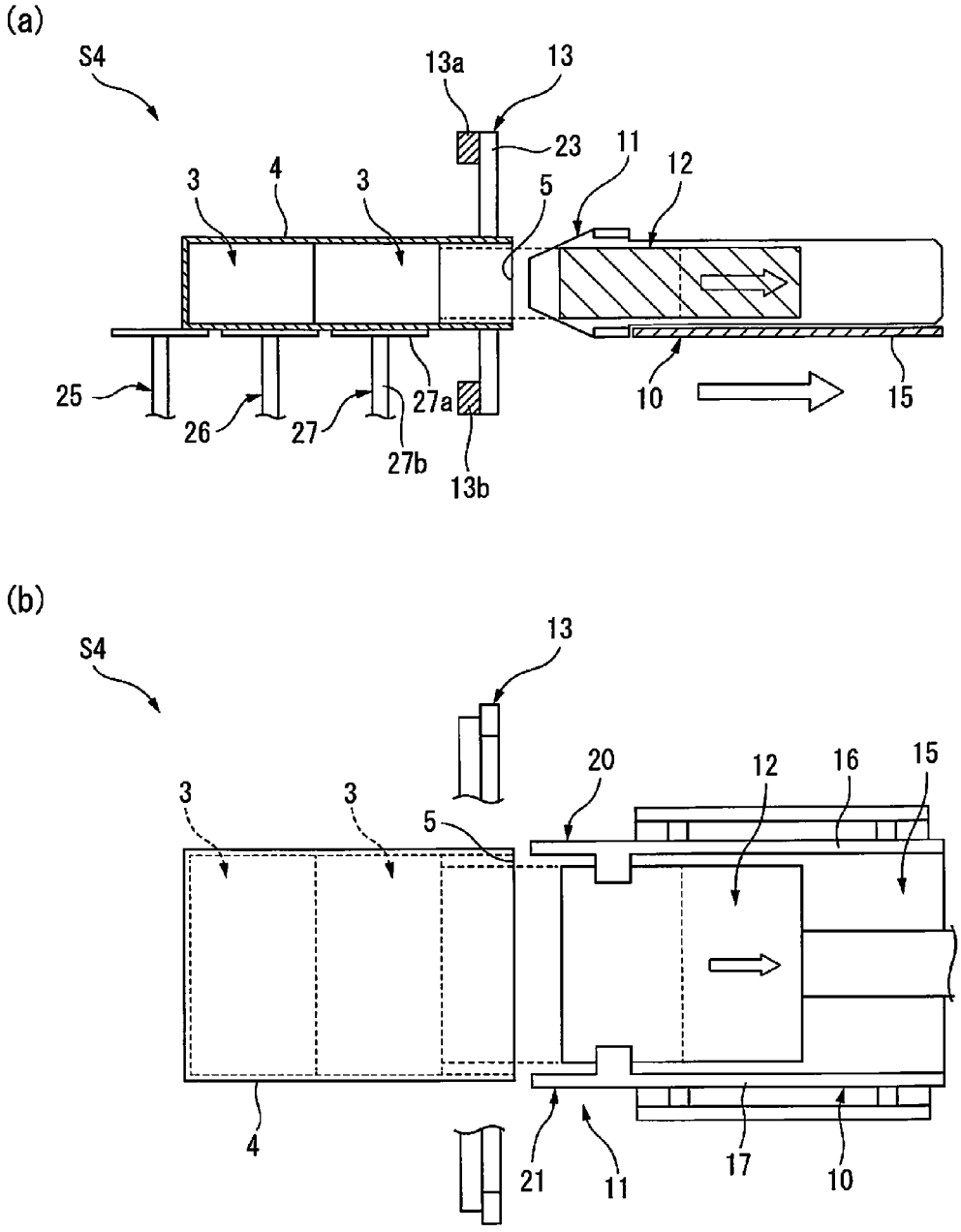
FIG. 7 is (a) a cross-sectional view and (b) a plan view schematically showing the housing step in the packaging method of the invention.

In the housing step S4, as shown in FIG. 6(*c*) or FIG. 7, after movement of the absorbent article groups 3 themselves on the base section 15 of the mount member 10 has been stopped by the stopping step S3, the mount member 10 continues to move forward with the forcing member 12 at the same location as in the previous step S3 in which movement of the absorbent article group 3 is stopped. Thus, as regards the absorbent article groups 3 whose movement has been stopped, although their actual location does not move, their location relative to the mount member 10 changes such that the absorbent article groups 3 move relative to the back side of the mount member 10 while sliding over the base section 15 along the first holding plate 16 and the second holding plate 17.

Moreover, the container fitting member 11 that is located on the back side of the mount member 10, along with forward movement of the mount member 10, approaches the absorbent article groups 3 whose movement has stopped, and the container 4 fitted on the container fitting member 11 takes in and houses the absorbent article groups 3 through the opening 5.

Furthermore, since the container fitting member 11 continues to move together with the mount member 10 even after the absorbent article groups 3 have been housed in the container 4, the forcing member 12 that has not moved from that location accomplishes the operation of forcing the absorbent article groups 3 into the container 4.

This results in the pair of absorbent article groups 3 being stably forced into the innermost part of the container 4. During this time, incidentally, the absorbent articles 2 composing the pair of absorbent article groups 3 are compressed by the first holding plate 16 and second holding plate 17 of the mount member 10, or are released from compression by the first mounting plate 20 and second mounting plate 21 of the container fitting member 11, and therefore the bulk is restored to some extent such that expansion takes place in the thickness direction in the container 4. Thus, the absorbent article groups 3 increase in size in the thickness direction of the absorbent articles 2, such that the absorbent article groups 3 cause tension of the surface of the container 4 from inside the container 4, allowing the absorbent articles 2 to be in a stably housed state.

Furthermore, in the housing step S4, as shown in FIGS. 7(*a*) and (*b*), the forcing member 12 still maintains the stopped state of the absorbent article group 3 at the same location as in the stopping step S3, so that a step is conducted in which the container 4 in which the absorbent article group 3 has been housed is detached from the forward-moving container fitting member 11 at the location where the opening 5 of the container 4 is sealed by the sealing member 13.

In other words, after the absorbent article groups 3 have been pushed up to the innermost part of the container 4, the forcing member 12 also blocks movement of the container 4 via the absorbent article groups 3 with which it is in contact, and therefore the container 4 is pulled out from the first mounting plate 20 and second mounting plate 21 of the container fitting member 11 by the forcing member 12. Consequently, the container 4 stops its movement at the location where it has been pulled out from the first mounting plate 20 and the second mounting plate 21, i.e. the location where the opening 5 of the container 4 is to be sealed by the sealing member 13.

Furthermore, after the absorbent article groups 3 have been housed in the container 4, the forcing member 12 moves in the direction away from the container 4, i.e. the direction opposite from the contact surface 12*a*, so that it does not interfere with the subsequent sealing step S5.

As a result, upon completion of the housing step S4, the container 4 in which the absorbent article groups 3 have been housed can be switched in a smooth and stable manner to the subsequent sealing step S5, without causing any particular movement of its location.

In the housing step S4, incidentally, forward movement of the mount member 10 and the container fitting member 11 causes the first to third support members 25 to 27 that are supporting from the lower side the container 4 in which the absorbent article groups 3 have been housed, either after detachment or before detachment from the mount member 10 and the container fitting member 11, to be raised in order depending on the forward-moving location of the mount member 10 and the container fitting member 11. That is, the forward movement of the moving member 18 of the mount member 10 releases engagement of the respective engaging members 25*c* to 27*c* of the first to third support members 25 to 27 with the lower side member 18*b* of the moving member 18, so that the upward triggering force by the elastic member causes the first to third support members 25 to 27 to be raised in order. As a result, the container 4 in which the absorbent article groups 3 have been housed is stably supported, preventing it from falling down from the packaging apparatus 1. The first support member 25 is raised in the stopping step S3, strictly speaking.

The sealing step S5 is carried out upon completion of the housing step S4.

In the sealing step S5, the opening 5 of the container 4 in which the absorbent article groups 3 have been housed is sealed, and it is rapidly carried out after the forcing member 12 has been moved in the direction away from the container 4 in the housing step S4 and has reached a location that does not interfere with operation of the sealing member 13.

Figure 8:
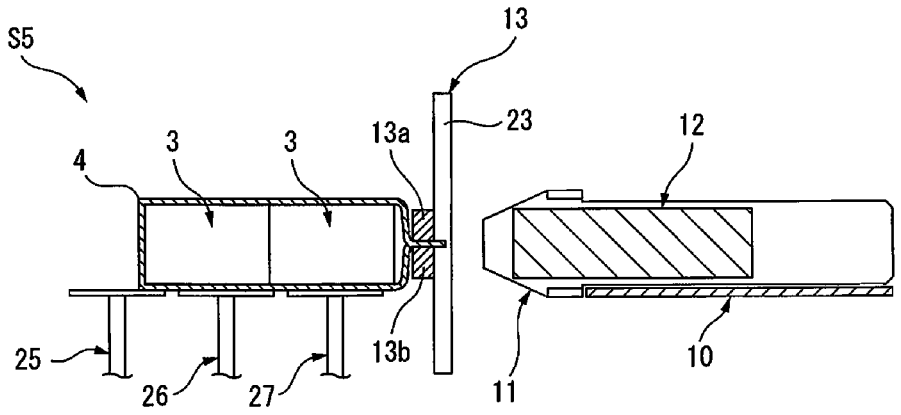
FIG. 8 is (a) a cross-sectional view during sealing and (b) a cross-sectional view after sealing, schematically showing the sealing step in the packaging method of the invention.
Figure 8:
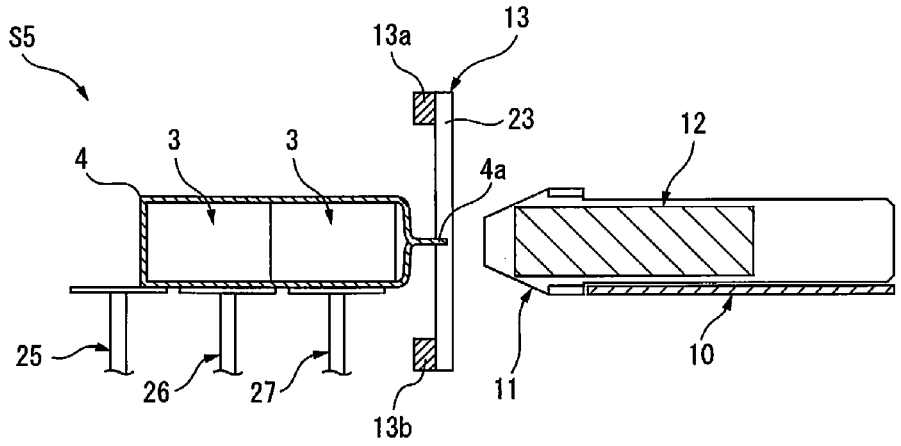

For this embodiment, the sealing member 13 comprises an upper and lower pair of heat welding members 13*a*, 13*b*, and as shown in FIG. 8(*a*), the area near the opening edges of the opening 5 of the container 4 removed from the container fitting member 11 and detached from the forcing member 12 is clamped from above and below, so that the section of the container 4 near the combined opening edges is bonded by heat welding, thereby sealing the opening 5. Then, as shown in FIG. 8(*b*), when sealing has been completed, the upper and lower pair of heat welding members 13*a*, 13*b* are moved in directions away from each other.

Thus, the container 4 in which the absorbent article groups 3 have been housed is sealed by formation of a seal section 4*a*, and packaging of the absorbent article groups 3 (absorbent articles 2) is thus complete.

Incidentally, once the sealing step S5 has been completed, the container 4 that has been completely sealed is recovered by the operator that mounted the absorbent article groups 3 on the mount member 10 in the mounting step S1. During this time, the initial location of the mount member 10 (the backward moving edge) and the location of the container 4 in which the absorbent article groups 3 have been housed, and whose opening 5 has been sealed, are separated only by the minimum necessary amount, thereby facilitating recovery.

Also, after recovery, the mount member 10 and the container fitting member 11 initiate backward movement, moving up to the backward moving edge, and steps S1 to S5 are repeated for the next packaging operation.

As explained above, according to the packaging apparatus 1 and packaging method of this embodiment, it is possible for a container 4 fitted onto a container fitting member 11, which is moving forward on the back side of a mount member 10 while the mount member 10 is moving forward, to incorporate inside it an absorbent article group 3 whose movement has been stopped by a forcing member 12, so that the absorbent article group 3 can be housed in the container 4 with little movement.

This makes it possible to minimize the distance between the location where the absorbent article group 3 is mounted on the mount member 10 and the container 4 location after it has housed the absorbent article group 3, and allows the absorbent article group 3 to be easily housed in the container 4, thereby allowing the series of packaging operations from housing the absorbent article group 3 in the container 4 after the absorbent article group 3 has been mounted on the mount member 10, up to the point of recovery, to be easily and efficiently carried out.

For the embodiment described above, the forcing member 12 stopped movement of the container 4 through the absorbent article group 3 so that the container 4 became detached from the container fitting member 11, but means apart from the forcing member, such as various means of detaching the container from the container fitting member by clamping the container housing the absorbent article groups, may be used for detachment of the container from the container fitting member.

Also for the embodiment described above, the mount member 10 and the container fitting member 11 were formed in an essentially integral manner, and more specifically the first holding plate 16 and first mounting plate 20, and the second holding plate 17 and second mounting plate 21, were each formed in an integral manner, but the mount member 10 and the container fitting member 11 may be mutually separate bodies so long as they can move forward and backward in synchronization and the distance between the first holding plate 16 and the second holding plate 17, and the distance between the first mounting plate 20 and the second mounting plate 21, can each be appropriately adjusted.

Also in the embodiment described above, the mount member 10 was clamped with the absorbent article groups 3 compressed between the first holding plate 16 and the second holding plate 17, but so long as the absorbent article groups can be smoothly inserted into the container, the mount member does not necessarily need to clamp the absorbent article groups in a compressed state by the first holding plate and second holding plate.

Furthermore, for the embodiment described above, the container fitting member 11 inserted the first mounting plate 20 and second mounting plate 21 into the container 4 through the opening 5 of the container 4, spreading open the opening 5 into a prescribed shape, but the container fitting member may instead spread out the opening so that the opening of the container is pulled by the first mounting plate and second mounting plate.

Also in the embodiment described above, the opening 5 of the container 4 was spread open in an essentially rectangular shape by the container fitting member 11, but the shape of the opening of the container when fitted onto the container fitting member may be set as desired depending on the shape and size of the absorbent article groups, the shape of the container, and the like.

Also in the embodiment described above, the packaging apparatus 1 was provided with support members 25 to 27 supporting the container 4 in which the absorbent article (group) has been housed, but the support members do not necessarily need to be provided. Even when they are provided, the number of support members does not necessarily need to be 3 as in the embodiment, and it may instead be 1, 2 or 4 or more. Furthermore, raising and lowering of the support members may employ any desired mechanism other than the mechanism of the described embodiment.

REFERENCE SIGNS LIST

1 Packaging apparatus
2 Absorbent article
3 Absorbent article group
4 Container
5 Opening
10 Mount member
11 Container fitting member
12 Forcing member
13 Sealing member
15 Base section
16 First holding plate
17 Second holding plate
20 First mounting plate
21 Second mounting plate
25-27 Support members

The invention claimed is:

1. A packaging apparatus for an absorbent article, that inserts an absorbent article group comprising multiple absorbent articles arranged in a thickness direction of the absorbent article group, through an opening of a container to house the absorbent article group in the container, and seals the opening, wherein the packaging apparatus comprises:

a mount member that mounts the absorbent article group, a container fitting member on which the container is fitted, a forcing member that forces the absorbent article group mounted on the mount member into the container fitted onto the container fitting member, and a sealing member that seals the opening of the container in which the absorbent article group has been housed, the mount member being formed in a manner freely forward/backward movable along an axis, the container fitting member being fitted onto a back side of the mount member and being formed in a manner freely forward/backward movable together with the mount member, and having a construction allowing fitting of the container while directing the opening in a forward direction of the mount member and holding the container open in a prescribed shape, the forcing member being provided in the forward direction of the mount member, and being contacted only with the absorbent article group mounted on the mount member to stop movement of the absorbent article group as the mount member moves forward, while inserting and forcing the absorbent article group whose movement has been stopped, through the opening into the container fitted onto the container fitting member that is moving forward together with the back side of the mount member, and the sealing member being provided in the forward direction of the mount member, and freely sealing the opening of the container into which the absorbent article group has been housed, and which has been detached from the container fitting member.

2. The packaging apparatus for an absorbent article according to claim 1, wherein the forcing member stops at a predetermined position in the forward direction of the mount member during a time when the forcing member is contacting with the absorbent article group until the absorbent article group is housed in the container, and after the absorbent article group has been housed in the container, the forcing member is moved in a direction away from the container.

3. The packaging apparatus for an absorbent article according to claim 1, wherein the forcing member maintains a stopped state of the absorbent article group, so that the container housing the absorbent article group is caused to detach from the container fitting member, as the containing fitting member moves forward, at a location where the opening of the container is to be sealed by the sealing member.

4. The packaging apparatus for an absorbent article according to claim 1, wherein the mount member comprises a horizontal plate-shaped base section on a top surface of which the absorbent article group is mounted, and a first holding plate and a second holding plate that are provided at the base section at a predetermined spacing in a horizontal direction perpendicular to the forward direction of the mount member, the first and second holding plates each extending upward in a vertical direction and extending in the forward direction of the mount member, and the first and second holding plates freely clamping the absorbent article group mounted on the base section between the first holding plate and the second holding plate, the first holding plate and the second holding plate both being set in a freely movable manner in the horizontal direction perpendicular to the forward direction of the mount member, with the spacing between the first holding plate and the second holding plate being freely adjustable.

5. The packaging apparatus for an absorbent article according to claim 4, wherein the mount member mounts the absorbent article group on the base section in a state such that the thickness direction of the absorbent article group is parallel to the horizontal direction perpendicular to the forward direction of the mount member, the first holding plate and second holding plate freely clamp the absorbent article group mounted on the base section in a compressed state of the absorbent article group in the thickness direction of the absorbent article group, and the forcing member inserts the absorbent article group compressed by the first holding plate and the second holding plate through the opening into the container that is fitted onto the container fitting member.

6. The packaging apparatus for an absorbent article according to claim 4, wherein the container fitting member is provided with a first mounting plate and a second mounting plate that are mutually disposed at the base section on the back side of the mount member, at a predetermined spacing in a direction perpendicular to a forward/backward direction of the container fitting member, the first and second mounting plates each being formed in a plate-shaped manner extending upward and extending in the forward/backward direction of the container fitting member, for opening the opening of the container to a prescribed shape, the first mounting plate and the second mounting plate both being set in a freely movable manner in the direction perpendicular to the forward/backward direction of the container fitting member, so that the spacing between the first mounting plate and second mounting plate is freely adjustable.

7. The packaging apparatus for an absorbent article according to claim 6, wherein the container fitting member has the first mounting plate and the second mounting plate inserted into the container through the opening of the container, and is fitted with the container with the opening in a spread open state.

8. The packaging apparatus for an absorbent article according to claim 6, wherein the first mounting plate of the container fitting member is at an edge of the first holding plate of the mount member on the back side of the mount member, with a plate surface of the first mounting plate and a plate surface of the first holding plate being mutually connected so as to define a first plane, while the second mounting plate of the container fitting member is at an edge of the second holding plate of the mount member on the back side of the mount member, with a plate surface of the second mounting plate and a plate surface of the second holding plate being mutually connected so as to define a second plane, and when the spacing between the first holding plate and the second holding plate has been adjusted, the spacing between the first mounting plate and the second mounting plate is also adjusted in synchronization.

9. The packaging apparatus for an absorbent article according to claim 1, wherein the packaging apparatus comprises a support member that supports the container in which the absorbent article group is housed.

* * * * *